United States Patent [19]

Bridge

[11] 4,225,246

[45] Sep. 30, 1980

[54] MIXING DEVICE

[75] Inventor: Iain N. Bridge, Beckbury, Nr. Shifnal, England

[73] Assignee: Bridge Storar Ltd., Wolverhampton, England

[21] Appl. No.: 931,977

[22] Filed: Aug. 8, 1978

Related U.S. Application Data

[63] Continuation-in-part of Ser. No. 835,320, Sep. 21, 1977, abandoned.

[30] Foreign Application Priority Data

Sep. 14, 1977 [GB] United Kingdom ..... 38255/77

[51] Int. Cl.[2] ..... B28C 5/20

[52] U.S. Cl. ..... 366/40; 366/57

[58] Field of Search ..... 366/54, 60, 55, 57, 366/170, 220, 225, 228, 229, 232, 240, 175, 44, 230, 40, 36, 34

[56] References Cited

U.S. PATENT DOCUMENTS

| | | | |
|---|---|---|---|
| 624,200 | 5/1899 | Fisher | 366/55 |
| 1,307,803 | 6/1919 | Shero | 366/55 |
| 1,358,405 | 11/1920 | Young | 366/225 |
| 2,623,737 | 12/1952 | McEachran | 366/175 |
| 2,817,501 | 12/1957 | Schubert | 366/232 |
| 3,232,586 | 2/1966 | McClive | 366/44 |
| 3,473,789 | 10/1969 | Dietrich | 366/55 |
| 3,592,448 | 7/1971 | Stevenson | 366/230 |

*Primary Examiner*—Robert W. Jenkins

[57] ABSTRACT

A mixing device comprises a hollow drum formed by a shell of substantially constant thickness and defining generally a body of revolution, preferably cylindrical, spheroidal or ellipsoidal. The drum includes internal vanes which are defined by corresponding grooves extending inwardly from the external surface of the drum, each groove having detachably positioned therein a comb of spikes. An opening is provided in one axial end of the drum by means of which the interior of the drum can be filled with and emptied of material. A handle is pivotally connected to the drum so that the drum is rollable along a supporting surface and rotatable relative to the handle about an axis coincident with the axis of said body of revolution during which rolling the vanes agitate the material within the drum. A spraying attachment can also be provided which includes a sprayer head connected to the interior of the drum by way of a pipe.

9 Claims, 7 Drawing Figures

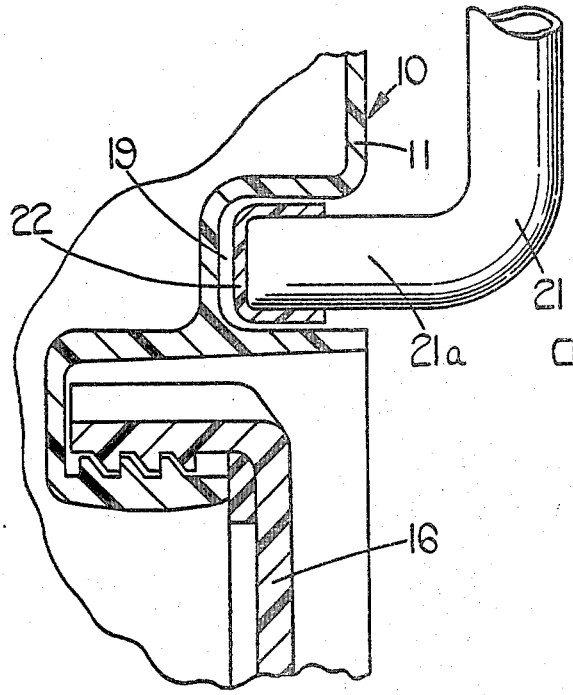
FIG.3.
FIG.4.
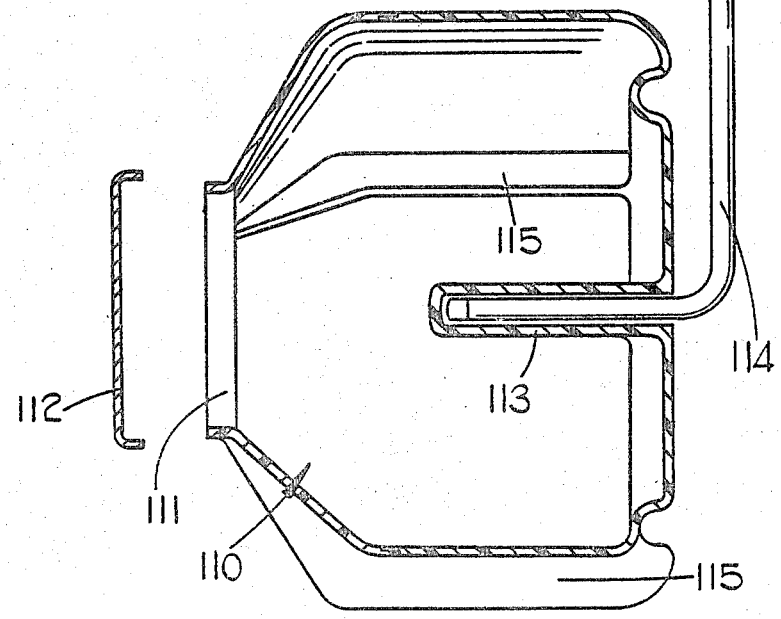

MIXING DEVICE

This application relates to a mixing device and is a continuation-in-part of my co-pending U.S. Pat. application Ser. No. 835,320 (now abondoned) filed Sept. 21, 1977. The mixing device is for use in mixing solids and/or liquids together, and it is an object of the invention to provide such a mixing device in a convenient form.

According to one aspect of the present invention, the present invention provides a mixing device comprising a hollow drum formed by a shell of substantially constant thickness and defining generally a body of revolution about a first axis, a handle pivotally connected to said drum so that said drum is rollable along a supporting surface and rotatable relative to said handle about a second axis which is parallel to and substantially coincident with said first axis, means defining an opening in said drum by means of which the interior of said drum can be filled with and emptied of a material to be mixed therein, and internal vanes in said drum for agitating said material when said drum is rolled along a supporting surface, each said internal vane being defined by a corresponding groove which extends inwardly from the external surface of said drum, each groove having detachably positioned therein a respective comb of spikes which project outwardly of said drum away from said first axis.

In use, the materials to be mixed are placed in the interior of the drum and the device is pushed or pulled so as to roll the drum along a supporting surface. The vanes cause agitation of the materials in the interior of the drum when the drum is so rolled, thereby mixing the materials together. At the same time, the mixing device can be used as a roller with the materials being mixed together within the drum acting as a suitable ballast for the rolling function. When the combs of spikes are fitted to the drum, the device can also be used as a lawn aerator. In both its rolling and aerating functions, the rolling or aerating pressure can be carefully controlled by placing a suitable amount of ballast in the drum.

The mixing device can further comprise a spraying attachment having a sprayer head which is connected to the interior of said drum by way of a pipe. Clip means can be provided for detachably mounting the sprayer head on the handle when the spraying attachment is not in use. In this way, the device can also be used for spraying purposes with the spraying liquid being contained within the drum. As the drum is rolled along a supporting surface, the vanes agitate the spraying liquid to maintain the latter well-mixed.

The drum can be made of substantially cylindrical shape. However, it is preferred to blow-mould the drum for which purpose it is advantageous to make the drum of generally spheroidal or ellipsoidal shape.

According to a second aspect of the present invention, there is provided a mixing device comprising a hollow drum defining generally a body of revolution about a first axis, a handle pivotally connected to said drum so that said drum is rotatable relative to said handle about a second axis which is parallel to and substantially coincident with said first axis, means defining an opening in said drum by means of which the interior of said drum can be filled with and emptied of a material, internal vanes in said drum for agitating said material when said drum is rolled along a supporting surface, and a spraying attachment having a sprayer head which is connected to the interior of said drum by way of a pipe.

Embodiments of the present invention will now be described, by way of example, with reference to the accompanying drawings, in which:

FIG. 3 is another enlarged fragmentary section through one end of the mixing device, taken on line 3—3 of FIG. 1;

FIG. 4 is a sectional view of a second embodiment of a mixing device according to the present invention;

Figure 1:
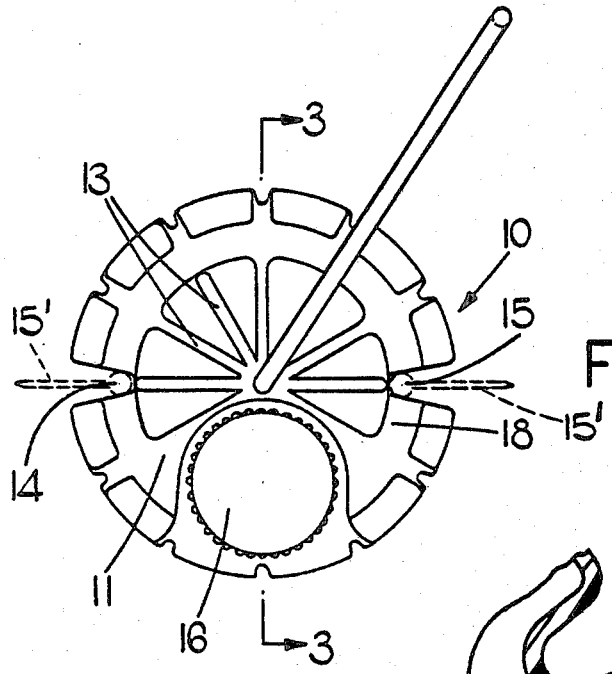
FIG. 1 is an end elevation of a first embodiment of a mixing device according to the present invention.
Figure 2:
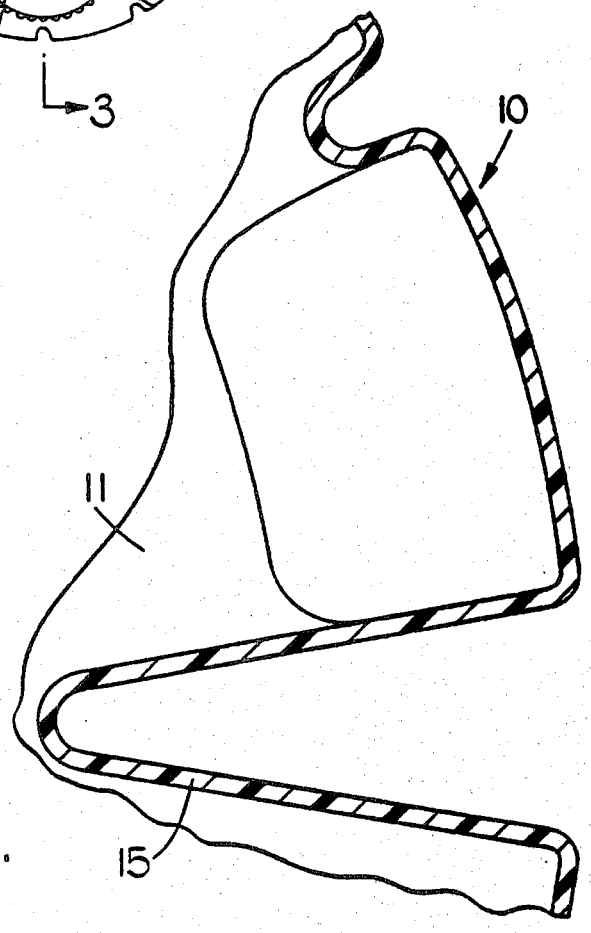
FIG. 2 is an enlarged fragmentary section of the mixing device shown in FIG. 1.

A first embodiment of the mixing device is shown in FIG. 1 and includes a drum 10 which is formed as a shell of a synthetic resin material or of a centrifugally cast metal. This shell 10 is of generally cylindrical form having end portions 11 on which strengthening ribs 13 are provided. A pair of vanes 14, 15 are formed integrally with the shell being of the same thickness as the shell 10. Thus, each vane is hollow and is defined by a corresponding groove in the external surface of the shell. Each of these grooves is designed to receive detachably a comb of spikes 15' (indicated in broken line in FIG. 1) so that the spikes extend radially of the axis of the cylindrical shell.

One of the end portions 11 is formed with an opening for filling and emptying the drum and a screw-threaded cap 16 is fitted over this opening. This opening is of diameter slightly less than half the diameter of the drum and is offset to one side of the axis of the drum. If desired, smaller openings (not shown) may be formed in the stopper and an auxiliary stopper (not shown) fitted in this smaller opening. A snap-on rubber cap can be used in place of the screw-threaded cap 16.

Each end portion 11 is also formed with an annular recess 18 which can be used for manually gripping the drum for lifting or tipping it. At the centre of each end portion 11 there is provided a recess 19 which is used for the pivotal mounting of a handle 21.

The handle 21 is formed from a length of resilient tube bent to a U-shaped configuration, with its ends bent inwards to define two inwardly projecting co-axial fingers 21*a*. A cap 22 is fitted on each such finger to prevent the end of the tube rapidly wearing through the material of the drum. The handle can be made in several pieces so that it can be dismantled for easy storage of the mixing device.

A second embodiment of the mixing device is shown in FIG. 4, wherein the drum 110 is formed with a single circular opening 111 at one end, the opening being co-axial with the drum and a portion of the drum adjacent this end being frusto-conically tapered towards the opening. A cap 112 can be fitted with snap action to the opening.

The other end of the drum is formed with an integral tubular bearing portion 113 projecting into the interior of the drum. The handle 114 is C-shaped having end portions which can be inserted into the bearing portion 113, so that when one end portion is thus inserted the other forms a hand grip.

As before the drum has mixing vanes 15 formed as before of hollow section and defined by corresponding grooves in the external surface of the drum 110 which are designed to receive combs of spikes (not shown for convenience) as before.

Figure 5:
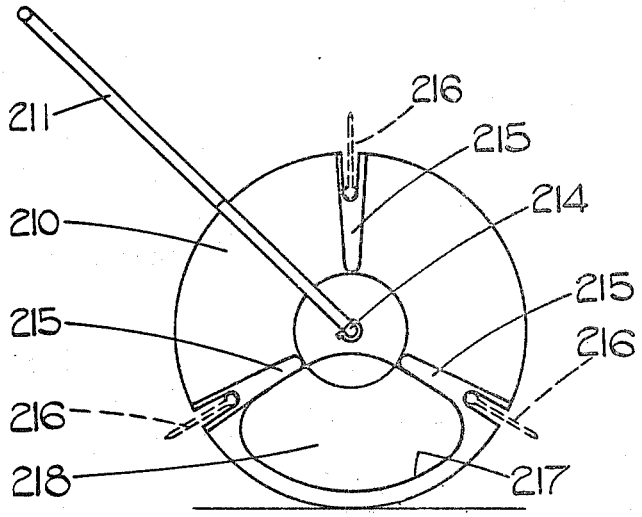
FIG. 5 is an end elevation of a third embodiment of a mixing device according to the present invention.
Figure 6:
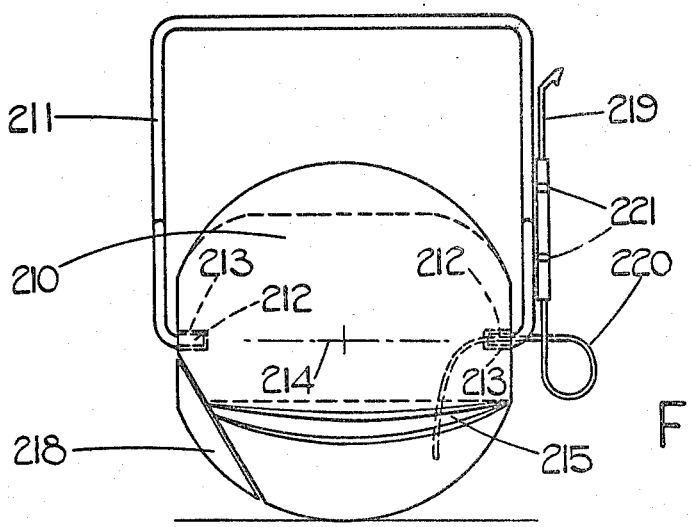
FIG. 6 is a front elevation of a mixing device shown in FIG. 5.
Figure 7:
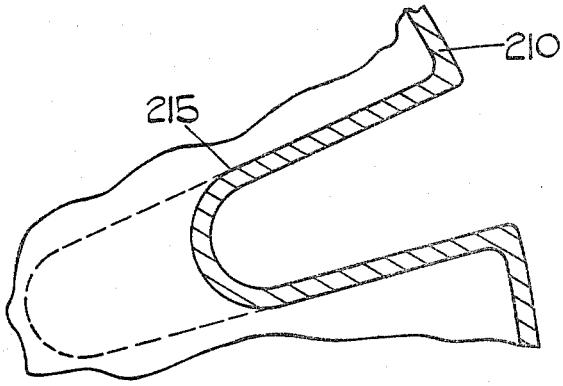
FIG. 7 is an enlarged fragmentary section of the mixing device shown in FIG. 5.

A third embodiment of the mixing device is shown in FIGS. 5 to 7 and comprises a hollow drum 210 formed by a generally spheroidal shell of substantially constant thickness. The shell is made of a synthetic resin material and is preferably blow-moulded although it can alternatively be centrifugally cast. Instead of being generally spheroidal, the shell can alternatively be generally ellipsoidal. A handle 211 is formed from a length of tube bent into a generally U-shaped configuration with its ends bent inwardly to define two inwardly projecting co-axial fingers 212. Each of these fingers 212 locates in a respective recess on the axis of the generally spheroidal drum 210 and has a cap 213 fitted thereon to prevent the end of the tube rapidly wearing through the material of the drum. The drum 210 can therefore be rotated relative to the handle 211 about an axis 214.

The drum 210 has three inwardly extending vanes 215 which are equi-angularly disposed around the axis 214. Each vane 215 is hollow so that it defines a corresponding groove in the external surface of the drum 210. Each of these grooves is designed to receive detachably a comb of spikes 216 (shown in broken line in FIG. 5) in the same manner as the grooves in the embodiment of Figure are designed to receive the combs of spikes 15'. The axial ends of the drum 210 are slightly flattened, and one of these ends has an opening 217 therein by means of which the interior of the drum can be filled with and emptied of material to be mixed. The opening 217 is offset to one side of the axis 214 and is located between two of the ribs 215. A cap 218 is detachably engaged with the drum 210 so as to close the opening 217 during usage of the device.

The mixing device of FIGS. 5 to 7 is also provided with a spraying attachment which includes a sprayer head 219 connected to the interior of the drum 210 by way of a pipe 220. Clip means 221 is provided for detachably mounting the sprayer head 219 on the handle 211. A similar spraying attachment can be provided with the devices shown in FIGS. 1 to 4. The handle 211 can be made in several pieces so that it can be dismantled for easy storage of the mixing device.

The mixing device shown in FIGS. 5 to 7 is easily cleaned and can easily be tipped for emptying the contents of the drum. The specific shape of the drum and its internal vanes provides a high strength-to-weight ratio and is easily mouldable. The shape of the drum also enables the mixing device to be manoeuvred easily, and mixing of the contents of the drum is achieved not only by rotation of the drum about the axis 214 but also by gravitational feed along the spaces in between the internal vanes.

I claim:

1. A mixing device comprising a hollow drum formed by a shell of substantially constant thickness and defining generally a body of revolution about a first axis, a handle pivotally connected to said drum so that said drum is rollable along a supporting surface and rotatable relative to said handle, means defining an opening in said drum by means of which the interior of said drum can be filled with and emptied of a material to be mixed therein, and internal axially extending vanes in said drum for agitating said material when said drum is rolled along said supporting surface, each said internal vane being defined by a corresponding groove which extends inwardly from the external surface of said drum, each groove having detachably positioned therein a comb of spikes which project outwardly of said drum away from said first axis.

2. The mixing device according to claim 1, further comprising a spraying attachment having a sprayer head and a pipe connected to said sprayer head extending to the interior of said drum.

3. The mixing device according to claim 2, wherein clip means is provided for detachably mounting said sprayer head on said handle.

4. The mixing device according to claim 1, wherein said body of revolution is defined at least partly by a curve which is concave to said first axis.

5. The mixing device according to claim 4, wherein said drum is generally spheroidal or ellipsoidal.

6. The mixing device according to claim 5, wherein said drum has been produced by being blow-mouled.

7. The mixing device according to claim 1, wherein said drum is substantially cylindrical.

8. The mixing device according to claim 1, wherein said handle is made of several parts which can be dismantled to facilitate storage of said mixing device.

9. A mixing device comprising a hollow drum defining generally a body of revolution about a first axis, a handle pivotally connected to said drum so that said drum is rollable along a supporting surface and rotatable relative to said handle, means defining an opening in said drum by means of which the interior of said drum can be filled with an emptied of a material to be mixed therein, internal axially extending vanes in said drum for agitating said material when a said drum is rolled along said supporting surface, and a spraying attachment having a sprayer head and a pipe connected to said sprayer head extending to the interior of said drum.

* * * * *